US006464491B2

(12) United States Patent
Rasmussen

(10) Patent No.: US 6,464,491 B2
(45) Date of Patent: Oct. 15, 2002

(54) GAS FLARE

(76) Inventor: Adair Rasmussen, 4828 - 53A Street, Camrose, Alberta (CA), T4V 1Z9

( * ) Notice: Subject to any disclaimer, the term of this patent is extended or adjusted under 35 U.S.C. 154(b) by 0 days.

(21) Appl. No.: 09/726,160

(22) Filed: Nov. 29, 2000

(65) Prior Publication Data

US 2001/0003038 A1 Jun. 7, 2001

(30) Foreign Application Priority Data

Dec. 6, 1999 (CA) ..... 2292199

(51) Int. Cl.[7] ..... F23G 7/08
(52) U.S. Cl. ..... 431/202; 422/174; 422/189
(58) Field of Search ..... 431/5, 170, 202; 110/210, 214, 250; 422/169, 174, 189

(56) References Cited

U.S. PATENT DOCUMENTS

| | | | | |
|---|---|---|---|---|
| 4,019,852 A | | 4/1977 | Hemmer et al. | 431/5 |
| 4,038,024 A | | 7/1977 | Straitz, III | 431/202 |
| 4,065,248 A | | 12/1977 | Straitz, III et al. | 431/202 |
| 4,070,146 A | | 1/1978 | Straitz, III | 431/202 |
| 4,090,840 A | | 5/1978 | Straitz, III | 431/14 |
| 4,127,380 A | | 11/1978 | Straitz, III | 431/15 |
| 4,128,389 A | | 12/1978 | Straitz, III | 431/202 |
| 4,139,339 A | | 2/1979 | Straitz, III | 431/202 |
| 4,323,343 A | | 4/1982 | Reed et al. | 431/202 |
| 4,344,751 A | | 8/1982 | Chesters | 431/202 |
| 4,892,477 A | | 1/1990 | Zimmiond | 431/202 |
| 4,969,405 A | * | 11/1990 | Goodrich | 110/210 |
| 5,024,817 A | * | 6/1991 | Mattison | 431/5 |
| 5,460,789 A | * | 10/1995 | Wilhelm | 422/174 |
| 5,938,426 A | | 8/1999 | McGehee | 431/202 |

FOREIGN PATENT DOCUMENTS

| | | | |
|---|---|---|---|
| JP | 5-332523 A | * 12/1993 | 110/210 |

* cited by examiner

*Primary Examiner*—Sara Clarke
(74) *Attorney, Agent, or Firm*—Christensen O'Connor Johnson Kindness PLLC

(57) ABSTRACT

A gas flare includes an elongate primary combustion chamber and at least one supplementary combustion chamber. A primary burner is positioned in the primary combustion chamber. A secondary burner is positioned in the supplementary combustion chamber. The primary combustion chamber has an outlet which is coupled with an inlet to the supplementary combustion chamber. A flow path is created for waste gas past the primary burner in the primary combustion chamber and past the supplementary burner in the supplementary combustion chamber, so the waste gas is subjected to multiple burner exposure for more complete combustion.

6 Claims, 4 Drawing Sheets

GAS FLARE

FIELD OF THE INVENTION

The present invention relates to a gas flare.

BACKGROUND OF THE INVENTION

Many oil wells produce small quantities of waste gas. The normal procedure has been to dispose of such small quantities of waste gas with a gas flare. In recent years, government regulations relating to protection of the environment have become more stringent. Flaring of waste gas is prohibited unless it meets emission standards. The oil wells that have been most affected by the more stringent regulations are those that produce hydrogen sulfide gas, commonly known as "sour" gas. Oil wells producing small quantities of sour gas are being shut down, as existing gas flare technologies are either incapable of meeting emission standards or so costly that the oil wells are no longer economically viable when equipped with such gas flares.

SUMMARY OF THE INVENTION

What is required is a gas flare that is capable of meeting stringent emission standards at a comparatively low cost.

According to the present invention there is provided a gas flare, which includes an elongate primary combustion chamber having a first end, a second end, an inlet at the first end, and an outlet at the second end. A primary burner is disposed between the first end and the second end. At least one elongate supplementary combustion chamber is also provided having a first end, a second end, an inlet at the first end, and an outlet at the second end. A supplementary burner is disposed between the first end and the second end. The outlet of the primary combustion chamber is coupled with the inlet of the supplementary combustion chamber, such that a flow path is created for waste gas past the primary burner in the primary combustion chamber and past at least one supplementary burner in the supplementary combustion chamber, whereby the waste gas is subjected to multiple burner exposure.

A gas flare constructed in accordance with the present invention operates on the principle that more complete combustion of waste gases is obtained when the waste gases are subjected to multiple burners. The preferred configuration involves supplementary combustion chambers which are stacked on top of the primary combustion chamber.

Once the basic teachings of the present invention are understood there are further measures that can be taken to increase efficiency. In order to ensure there is adequate oxygen for combustion, each of the supplementary combustion chambers has a supplementary source of combustion air. In order to ensure that the heat is sufficient to ensure as complete a burn as possible, the primary burner and each of the supplementary burners is an electric heating element. Electric heating elements permit greater temperature control.

Although beneficial results may be obtained through the use of the gas flare, as described above, even more beneficial results may be obtained when the outlet of the last of the supplementary combustion chambers is connected to a cooling and chemical reaction chamber. This enables chemicals to be introduced into and react with the waste gas as it cools. The addition of chemicals can turn the residue of the waste gas into a usable byproduct. For example, the addition of ammonia in controlled quantities can turn sour gas residue into fertilizer.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
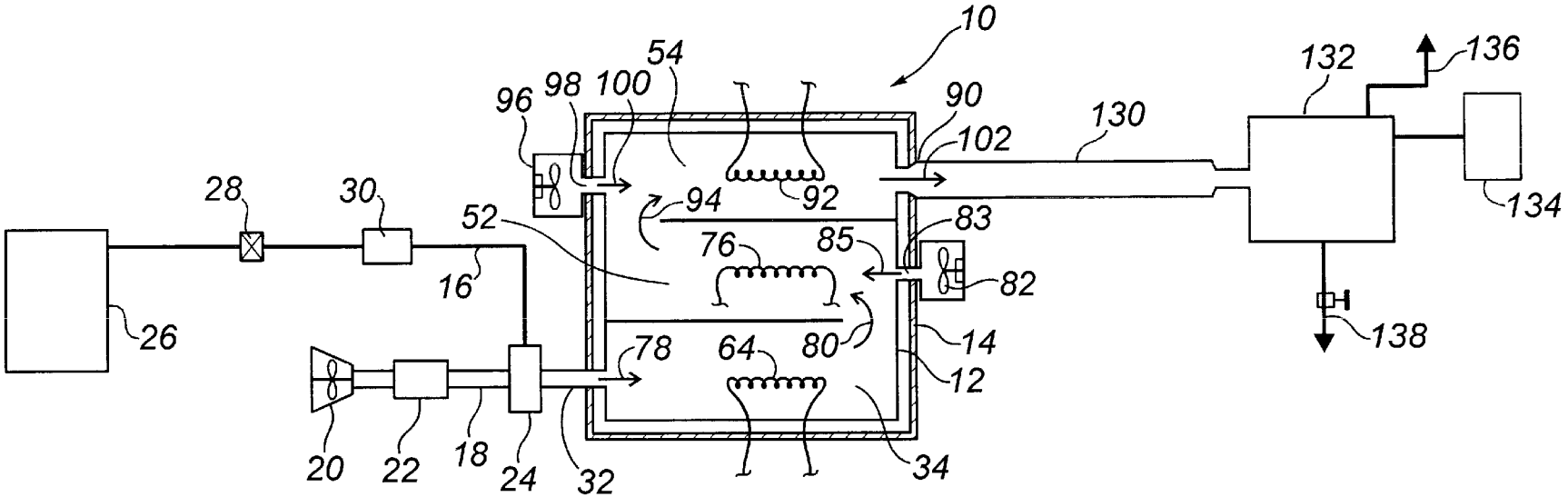
FIG. 1 is a schematic diagram of a gas flare fitted onto a source of waste gas.

The preferred embodiment, a gas flare generally identified by reference numeral 10, will now be described with reference to FIGS. 1 through 4.

Referring to FIG. 1, gas flare 10 includes a body 12 and an insulating enclosure 14. A gas feed line 16 feeds gas into an air feed line 18. Air is driven along air feed line 18 by a first fan 20 and through a first flame arrestor 22 and a venturi 24. The action of the air passing through venturi 24 draws a combustible waste gas along gas feed line 16 from a source 26, such as a tank, through a check valve 28 and a second flame arrestor 30. The mixture of waste gas and air is forced from venturi 24 through insulating enclosure 14 via an inlet 32 into a first elongate primary combustion chamber 34 of body 12.

Figure 2:
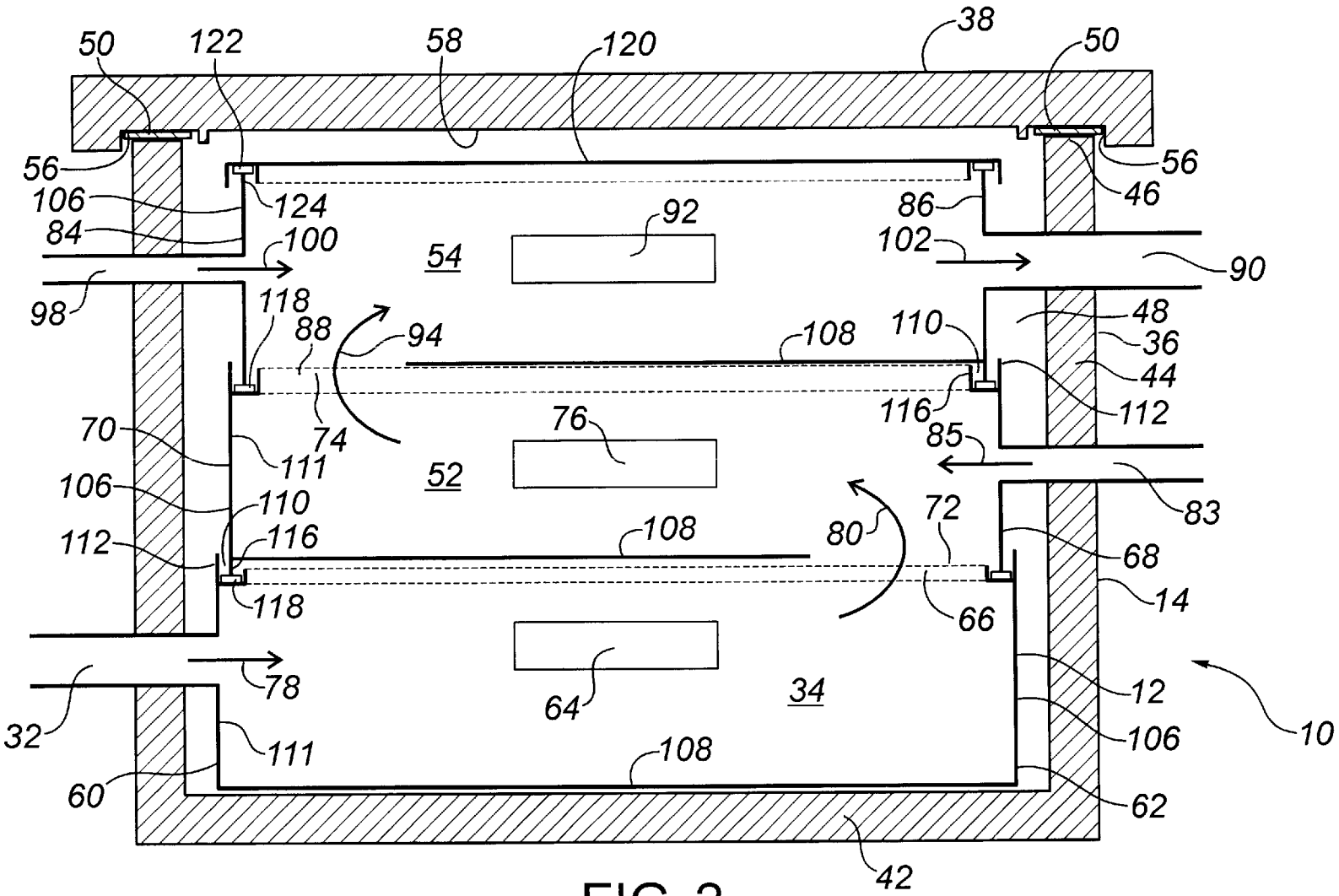
FIG. 2 is a side elevation view in section of the gas flare shown in FIG. 1.

Referring to FIG. 2, insulating enclosure 14 has a body 36 and a lid 38. Body 36 of insulating enclosure 14 has a base 42 and peripheral sidewalls 44 extending upward from base 42 to an upper peripheral edge 46, defining an interior cavity 48. A gasket 50 provides an air tight seal between upper peripheral edge 46 of peripheral sidewalls 44 and a periphery 56 of bottom surface 58 of lid 38.

Figure 3:
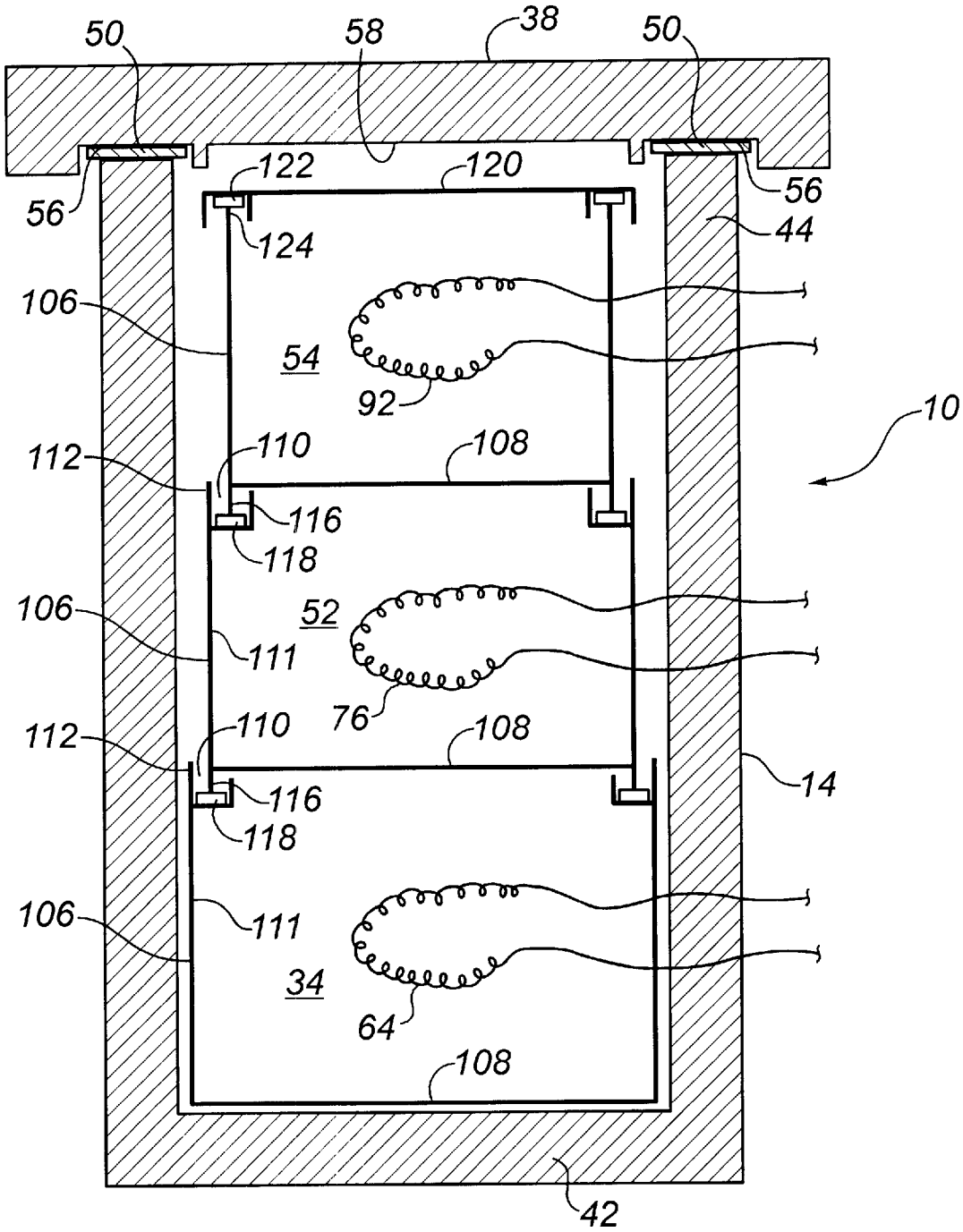
FIG. 3 is an end elevation view in section of the gas flare shown in FIG. 1.

Body 12 of gas flare 10 is constructed of a material capable of withstanding exposure to temperatures up to 3000 F. without sustaining damage or distortion. Body 12 of gas flare 10 has several levels, including elongate primary combustion chamber 34 positioned at a first level, an elongate first supplementary combustion chamber 52 positioned at a second level, and an elongate second supplementary combustion chamber 54 positioned at a third level. There are several ways in which the levels of body 12 can be assembled. Referring to FIG. 3, it has been found that one method by which the levels of body 12 can be stacked so as to minimize heat losses and to minimize the a size of interior cavity 48 of insulating enclosure 14 within which body 12 is located is as follows. Each of primary combustion chamber 34, first supplementary combustion chamber 52 and second combustion chamber 54 has peripheral sidewalls 106 and a base 108. Sidewalls 106 of each of first supplementary combustion chamber 52 and second supplementary combustion chamber 54 extend below base 108. A peripheral trough 110 extends around an interior surface 111 at an upper peripheral edge 112 of sidewalls 106 of each of primary combustion chamber 34 and first supplementary combustion chamber 52. Each of first supplementary combustion chamber 52 and second supplementary chamber 54 are sized such that a lower peripheral edge 116 of sidewalls 106 can sit within trough 110 of the level immediately below. A gasket 118 provides for a gas tight seal between lower peripheral edge 116 of sidewalls 106 and trough 110. Base 108 of first supplemental combustion chamber 52 encloses a top of primary combustion chamber 34 and base 108 of second supplementary combustion chamber 54 encloses a top of first supplementary combustion chamber 52. A lid 120 closes the top of second supplementary combustion chamber 54. A gasket 122 provides for a gas tight seal between an upper peripheral edge 124 of sidewalls 106 of second supplemental combustion chamber 54 and lid 120.

Referring to FIG. 2, primary combustion chamber 34 has a first end 60 and a second end 62. Inlet 32 feeds the mixture of air and combustible gas into primary combustion chamber 34 at first end 60 as indicated by arrow 78. A primary burner 64 in the form of an electric heating element is disposed between first end 60 and second end 62. An outlet 66 is at second end 62 of primary combustion chamber 34.

First supplementary combustion chamber 52 has a first end 68, a second end 70, an inlet 72 at first end 68, an outlet 74 at second end 70, and a first supplementary burner 76 in the form of an electric heating element disposed between first end 68 and second end 70. When the levels of body 12 are stacked as shown in FIG. 2, outlet 66 of primary combustion chamber 34 is coupled with inlet 72 of first supplementary combustion chamber 52. Referring to FIG. 1, a second fan 82 forces air through a first supplementary air inlet 83 into first supplementary combustion chamber 52, as indicated by arrow 85 to support combustion of the waste gas by first supplemental burner 76.

Referring to FIG. 2, second supplementary combustion chamber 54 has a first end 84, a second end 86, an inlet 88 at first end 84, an outlet 90 at second end 86, and a second supplementary burner 92 in the form of an electric heating element disposed between first end 84 and second end 86. Referring to FIG. 1, a third fan 96 forces air through a second supplementary air inlet 98 into second supplementary combustion chamber 54, as indicated by arrow 100 to support combustion of the waste gas by second supplemental burner 92. When the levels of body 12 are stacked as shown in FIG. 2, outlet 74 of first supplementary combustion chamber 52 is coupled with inlet 88 of second supplementary combustion chamber 54. A flow path is created for waste gas past primary burner 64 in primary combustion chamber 34 as indicated by arrow 78, past first supplementary burner 76 in first supplementary combustion chamber 52 as indicated by arrow 80, and past second supplementary burner 92 in second supplementary combustion chamber 54 as indicated by arrow 94. The waste gas thereby is subjected to multiple burner exposure before exiting second supplementary combustion chamber 54 via outlet 90, as indicated by arrow 102.

The use of electric heating elements for primary burner 64, first supplementary burner 76 and second supplementary burner 92 with insulating enclosure 14 enables a temperature in each of the levels of body 12 to be kept substantially constant during operation of gas flare 10.

The provision of air through first supplementary air inlet 83 and second supplementary air inlet 98 ensures that the ratio of air to waste gases is high enough so that sufficient air is available for the complete combustion of waste gases from source 26. A ratio of 10 volumes of air for each volume of waste gases has been found to be sufficient for several applications using gas flare 10.

Referring to FIG. 1, first flame arrestor 22 and second flame arrestor 30 serve to prevent flash back from gas flare 10 into air feed line 18 and gas feed line 16 in the event that there is a power failure and first fan 20 is not operating.

The nature of the products from combustion of waste gas either may be harmful, and so cannot be discharged into the atmosphere, or may be valuable as chemical feedstock, and so may be worth capturing. For example, when the waste gas contains hydrogen sulfide, combustion of said waste gas produces oxides of sulfur. It is undesirable to vent oxides of sulfur as they are harmful pollutants and they are a factor in the formation of acid rain. It is therefore desirable to scrub oxides of sulfur from the exit gases from second supplementary combustion chamber 54. Oxides of sulfur can be reacted with other chemical reagents to form useful and valuable products, such as a reaction with ammonia to form a compound valuable as a fertilizer. Referring to FIG. 1, outlet 90 of second supplementary combustion chamber 54 is connected to a combination of a cooling chamber 130 and a chemical reaction chamber 132 external to insulating enclosure 14. Chemical reagents are introduced from a supply vessel 134 into chemical reaction chamber 132 and react with the products from combustion of the waste gas as the products cool or after they are cooled. Depleted exhaust gases are vented to atmosphere through vent 136 and the reaction products are continually removed after reaction through take of 138.

Figure 4:
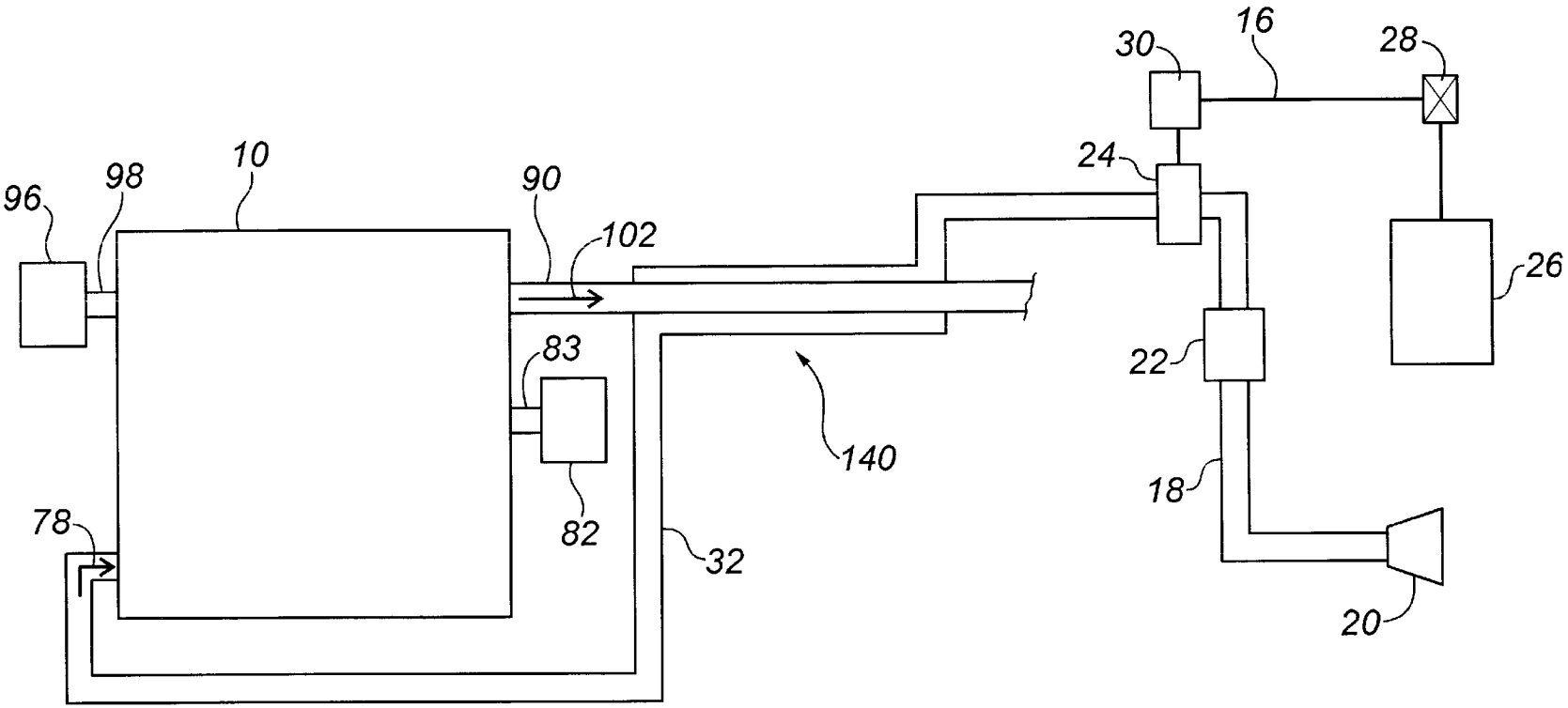
FIG. 4 is a schematic diagram of the gas flare shown in FIG. 1 with heat exchange capability.

Gas flare 10 can be reconfigured so that a section of outlet 90 and a section of inlet 32 together serve as a heat exchanger 140, as illustrated schematically in FIG. 4. The heat of the hot exhaust from outlet 90 is used to pre-heat the mixture of air and waste gases fed through inlet 32 into primary combustion chamber 34, thereby improving the overall thermal and operating efficiency of gas flare 10.

In prototype development is was discovered that only high temperature materials could be used. This led to the use of ceramic in the commercial version. With the switch to ceramic the unit became one piece rather than modular, as had been the case with the original proto-type. It was also determined that better performance could be obtained when the electrical elements used as burners were spaced at intervals along each combustion chamber. The number of electrical elements used depends upon the length of the unit. With a combusion chamber thirty four inches long, three electrical elements were found to be adequate.

Care should be taken when introducing gas into the unit. The unit should be preheated in preparation for receiving the gas. There should also be circulating through the unit an abundant supply of combustion air. If gas is allowed to accummulate in the unit and is then ignited, an explosion may occur.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A gas flare, comprising:

an elongate primary combustion chamber having a first end, a second end, an inlet at the first end, an outlet at the second end and at least one primary burner disposed between the first end and the second end;

at least one elongate supplementary combustion chamber having a first end, a second end, an inlet at the first end, an outlet at the second end and at least one supplementary burner disposed between the first end and the second end, the outlet of the primary combustion chamber being coupled with the inlet of the at least one supplementary combustion chamber, such that a flow path is created for waste gas past the at least one primary burner in the primary combustion chamber and past the at least one supplementary burner in the at least one supplementary combustion chamber, whereby the waste gas is subjected to multiple burner exposure, each of the at least one supplementary combustion chambers having a supplementary source of combustion air.

2. The gas flare as defined in claim 1, wherein the at least one primary burner and each of the at least one supplementary burners is an electric heating element.

3. The gas flare as defined in claim 1, wherein the at least one supplementary combustion chamber is stacked on top of the primary combustion chamber.

4. A gas flare, comprising:

an elongate primary combustion chamber having a first end, a second end, an inlet at the first end, an outlet at the second end and at least one primary burner disposed between the first end and the second end;

at least one elongate supplementary combustion chamber having a first end, a second end, an inlet at the first end, an outlet at the second end and at least one supplementary burner disposed between the first end and the second end, the outlet of the primary combustion chamber being coupled with the inlet of the at least one supplementary combustion chamber, such that a flow path is created for waste gas past the at least one primary burner in the primary combustion chamber and past the at least one supplementary burner in the at least one supplementary combustion chamber, whereby the waste gas is subjected to multiple burner exposure, wherein the outlet of the at least one supplementary combustion chamber is connected to a cooling and chemical reaction chamber, whereby chemicals are introduced into and react with the waste gas as it cools.

5. A gas flare, comprising:

a body having several levels, including:

an elongate primary combustion chamber positioned on a first level, the primary combustion chamber having a first end, a second end, and inlet at the first end, an outlet at the second end and a primary burner assembly in the form of electric heating elements disposed between the first end and the second end;

a elongate first supplementary combustion chamber positioned on a second level above the first level, the first supplementary combustion chamber having a first end, a second end, an inlet at the first end, an outlet at the second end and a first supplementary burner assembly in the form of electric heating elements disposed between the first end and the second end, the outlet of the primary combustion chamber being coupled with the inlet of the first supplementary combustion chamber;

a elongate first supplementary combustion chamber positioned on a third level above the second level, the second supplementary combustion chamber having a first end, a second end, an inlet at the first end, an outlet at the second end and a second supplementary burner assembly in the form of an electric heating element disposed between the first end and the second end, the outlet of the first supplementary combustion chamber being coupled with the inlet of the second supplementary combustion chamber, such that a flow path is created for waste gas past the primary burner assembly in the primary combustion chamber, past the first supplementary burner assembly in the first supplementary combustion chamber and past the second supplementary burner assembly in the second supplementary combustion chamber, whereby the waste gas is subjected to multiple burner exposure, each of the fist supplementary combustion chamber and the second supplementary combustion chambers have a supplementary source of combustion air.

6. The gas flare as defined in claim 5, wherein the outlet of the second supplementary combustion chamber is connected to a cooling and chemical reaction chamber, whereby chemicals are introduced into and react with the waste gas as it cools.

* * * * *

UNITED STATES PATENT AND TRADEMARK OFFICE

CERTIFICATE OF CORRECTION

PATENT NO. : 6,464,491 B2
DATED : October 15, 2002
INVENTOR(S) : A. Rasmussen

It is certified that error appears in the above-identified patent and that said Letters Patent is hereby corrected as shown below:

Column 6,
Line 19, “first supplementary” should read -- second supplementary --
Line 29, “fist” should read -- first --

Signed and Sealed this

Twenty-fifth Day of March, 2003

JAMES E. ROGAN
*Director of the United States Patent and Trademark Office*